US008118198B1

(12) United States Patent
Watson

(10) Patent No.: US 8,118,198 B1
(45) Date of Patent: Feb. 21, 2012

(54) POURING SPOUT WITH CONTROLLING MEANS

(76) Inventor: Edwin George Watson, Cherry Hill, NJ (US)

( * ) Notice: Subject to any disclaimer, the term of this patent is extended or adjusted under 35 U.S.C. 154(b) by 1403 days.

(21) Appl. No.: 11/087,244

(22) Filed: Mar. 23, 2005

Related U.S. Application Data

(60) Provisional application No. 60/556,211, filed on Mar. 25, 2004.

(51) Int. Cl.
*B65D 25/40* (2006.01)

(52) U.S. Cl. ..... 222/462; 222/529; 222/532; 222/566

(58) Field of Classification Search ..... 222/460–462, 222/567, 570, 574, 566, 527, 528, 529–532; 141/332, 337, 338
See application file for complete search history.

(56) References Cited

U.S. PATENT DOCUMENTS

| | | | | | |
|---|---|---|---|---|---|
| 1,935,324 | A | * | 11/1933 | Lillard | 141/337 |
| 2,053,298 | A | * | 9/1936 | Reed | 229/4.5 |
| 2,100,888 | A | * | 11/1937 | Vine | 141/337 |
| 2,665,033 | A | * | 1/1954 | Robertson | 222/107 |
| 2,990,100 | A | * | 6/1961 | Randak | 383/43 |
| 3,040,951 | A | * | 6/1962 | Kuchenbecker | 229/217 |
| 3,165,243 | A | * | 1/1965 | Haynes | 222/498 |
| 3,300,099 | A | * | 1/1967 | Marona | 222/207 |
| 3,324,906 | A | * | 6/1967 | Chu | 141/114 |
| 3,572,318 | A | * | 3/1971 | Garland | 600/574 |
| 3,815,794 | A | | 6/1974 | Carlisle | |
| 3,841,535 | A | * | 10/1974 | Taupin | 222/502 |
| 4,797,309 | A | * | 1/1989 | Kammerer et al. | 428/35.3 |
| 4,832,238 | A | | 5/1989 | Taylor | |
| 4,979,655 | A | | 12/1990 | Gallucci | |
| 5,101,870 | A | | 4/1992 | Farris | |
| 5,156,286 | A | | 10/1992 | Piccard | |
| 5,228,488 | A | * | 7/1993 | Fletcher | 141/331 |
| 5,230,442 | A | | 7/1993 | Dean | |
| 5,246,126 | A | | 9/1993 | Lewis | |
| 6,431,415 | B1 | * | 8/2002 | Schreiber | 222/460 |
| 6,446,847 | B1 | * | 9/2002 | Huffer | 222/541.9 |
| 6,484,905 | B1 | * | 11/2002 | Swackhamer et al. | 222/158 |
| 2002/0074247 | A1 | * | 6/2002 | Tremblay | 206/223 |
| 2003/0000973 | A1 | | 1/2003 | Martin | |
| 2004/0118869 | A1 | * | 6/2004 | Ferranda | 222/107 |
| 2004/0256027 | A1 | * | 12/2004 | Salani et al. | 141/337 |

OTHER PUBLICATIONS fastfunnel.com Disposable Funnel.

* cited by examiner

*Primary Examiner* — J. Casimer Jacyna

(57) ABSTRACT

The disclosed preferred embodiment of the current invention relates to a spout or a spout extension system for assisting in the transfer of pourable material from a storage container to a receiving destination or equipment. Said spout extension has a means of controlling the flow of said material allowing for the inversion and positioning of said container spout combination, prior to initiating the flow. More particularly this invention relates to an attachable spout extension, said extension contains a control means or valve which can be operated when the container and spout extension combination is inverted and positioned in the desired location prior to commencing flow of material.

18 Claims, 11 Drawing Sheets

POURING SPOUT WITH CONTROLLING MEANS

CROSS REFERENCE TO RELATED APPLICATIONS

1. Provisional Patent Application, Application No. 60/556, 211 Title: Pouring Spout with Controlling Means, Filed: Mar. 25, 2004, claiming priority.
2. Disclosure Document Submitted under USPTO Disclosure Program Title: Pouring Spout with Controlling Means, Filed: Mar. 26, 2002 Document #508887 (referenced in above provisional application as disclosure date)

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

1. Field of the Invention

This invention generally pertains to pouring spouts for the transfer of material from containers to receiving destinations and more particularly to a pouring spout with functionality to control the flow of material through it, while inverting and positioning said container and spout.

2. Description of the Prior Art

Many devices exist to assist in the transfer of liquids or other pourable solid materials from a storage or supply container, to a destination container, or piece of equipment. One such specific example is the pouring of lubricating oil from the supply container into an engine located in a vehicle. In such an example the typical supply container has a roughly circular neck and spout, which may have a threaded on cap or closure. The destination or receiving location for transfer of said lubrication oil is typically an opening located on the engine and can be positioned deep in the engine compartment and surrounded by obstructions such as hoses or other structure. Such tight locations or obstructions make it difficult to begin pouring a mostly full, uncapped container of said oil by inverting said container and quickly positioning said container spout into said receiving opening on said engine, without spilling said oil. Well known is the use of a funnel, which can have one end installed into the receiving opening while having the other end held in an open area where the inversion of said oil container can occur without obstruction, and pouring can commence without spillage. However a funnel is not always available and also may require clean out after use to remove left over oil and also introduces foreign matter from the last use. Without an available funnel the user is left with trying to invert an uncapped, mostly full container of oil while quickly attempting to insert said containers spout into the receiving opening in the engine, all while the pouring has started. This attempt typically results in spillage.

Some applications, because of obstructions surrounding the receiving opening, or size differences between the receiving opening and the containers spout, will not allow the container spout to be inserted in said receiving opening. In this case said container is inverted and said spout is located above the receiving opening, while the user suspends the container over the opening, during the pouring process. This process typically results in spillage.

Multiple pouring spouts have been previously designed and put in practice, and have to some degree provided solutions to the problem. These designs are typically difficult to store, awkward to operate, require cleaning after use, and are not usually disposable. Therefore, it is the general object of this invention to improve upon the prior art.

BRIEF SUMMARY OF THE INVENTION

It is the object of an embodiment of the present invention to provide a novel and improved pouring spout for the transfer of material from a supply container to a receiving destination, and thus satisfy the needs of the art. Said pouring spout provides a means to extend the container nozzle, a means to attach the disclosed device to said container, and means to direct, and control the flow or transfer of said material from said container, and allows for inversion and proper positioning of said container with spout, prior to the commencement of material flow, thus greatly reducing the incidence of spilling material.

Accordingly an embodiment of the present invention is a pouring spout being an elongated hollow shape having a first end and a second end. Said first end is approximately circular in shape and tapered and has means to attach to the neck of a container. Said elongated spout transitions from said first end, having an approximately circular shape to said second end, having an approximate rectangular shape. Said second end has a sealing means which seals said second end and allows for control of flow through said spout, including when said container and spout assembly is inverted. Said sealing means can be comprised of multiple, essentially flat wall segments, said walls being interconnected by hinge lines, allowing said second end to change shape by the movement of said walls and the bending of said hinge lines. Said second end and said sealing means can be moved from a first closed position, to a second open position. An adhesive like material can hold said walls in close proximity, resulting in said second end being in said closed position. Said hinge lines extend at least part way along said elongated spout.

When a user provides an opposing force at any location along at least a pair of said hinge lines, said force is transmitted to said sealing means, and in this example, overcomes said adhesive material holding force, and moves said walls to said second open position, said opening action can commence flow. Said process of applying said force and moving said second end to said open position, is best performed after said container and spout assembly is inverted and properly located near the desired destination for material transfer, allowing for spill-free transfer of said material.

Accordingly, several additional embodiments of the present invention can be devised and are presented herein.

BRIEF DESCRIPTION OF THE DRAWINGS

The current invention is best understood when read in conjunction with the attached drawings as outlined below.

DETAILED DESCRIPTION OF THE INVENTION

Figure 1A:
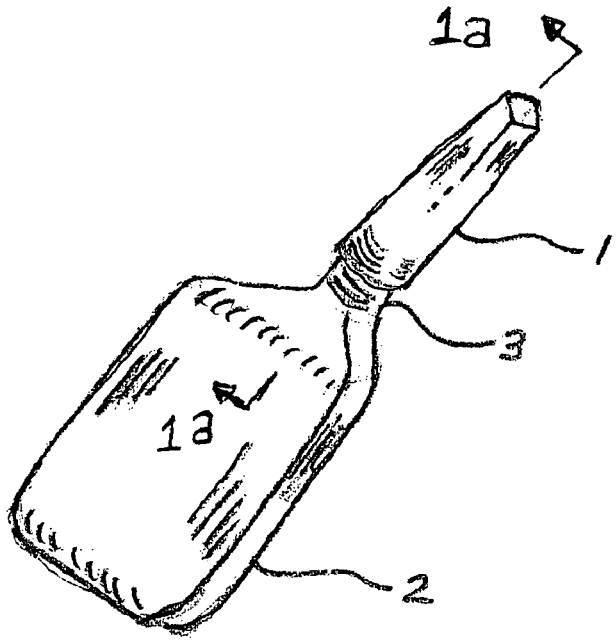
FIG. 1*a* is an isometric view of a spout attached to a container, as the preferred embodiment of the invention.
Figure 1B:
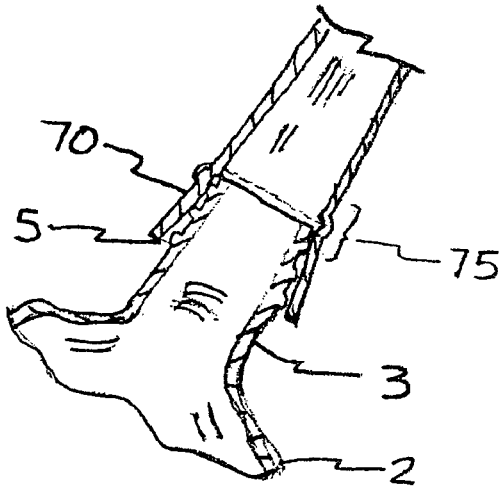
FIG. 1*b* shows a cross section of the attachment to a container of the spout. as viewed from the section line 1*a*-1*a* of FIG. 1.

According to FIG. 1*a* a spout 1 for a container 2 is anticipated, said container being represented by a motor oil bottle with a container neck 3, having a container outlet, for the storage and transfer of material from said container to a given destination, including another container, a piece of machinery, or an engine and the like.

Referring to FIGS. 1*a*, 1*b*, 2*a*, 2*b*, 2*c*, and 3, an embodiment of the invention is shown as a spout 1 for the controlled transfer of material from a container 2 in an inverted position. Said spout is comprised of an elongated hollow member 1 having a first end 70, an intermediate portion 71, and a second end 72. Said first end 70 has a first opening 5 and said second end 72 has a second opening 6. Said elongated hollow member 1 generally has an inside surface 73 and an outside surface 74. Said first opening 5 is shown substantially circular in shape, and said first end 70 (FIG. 1*b*) is shown being tapered to fit a range of sizes of necks 3 of said container 2, when fitted to said container. Said first end may be constructed of thin walled material or an additional layer or layers of material, that is partially conformable to the shape of said container neck, when said container neck is inserted into said first end. Said container neck, weather having a smooth outer surface or having threads or other raised features, when mated with said tapered first end, first contacts said inside surface of said tapered first end. When an additional insertion force is applied after initial contact, said conformable first end then locally deforms or is reshaped, near the contact location 75 of said container neck, and results in a jam, friction, or force fit. Said container neck when force fitted into said tapered first end, forms a seal and a mechanical attachment, whereby said transferred material is prevented from leaking at said contact location 75, and said elongated spout 1 is structurally attached to said container neck 3, respectively.

Said circular shape of said first end 70 (FIG. 2*c*) can be approximated by a multiplicity of flat wall segments 76, interconnected by fold lines 77 which essentially form a circular shape 78.

Said substantially circular shape at said first end 70 (FIGS. 2*a*, 2*b*, and 2*c*), transitions to a substantially rectangular shape at said second end 72, through said intermediate portion 71. Said second end 72 is composed of a plurality of substantially flat walls 13, 14, 15, and 16, said walls joined by hinge lines 10,11,60, and 61, said walls and hinge lines extending at least partially along the length of said elongated member. Said hinge lines can be hingedly connected fold lines.

Figure 4A:
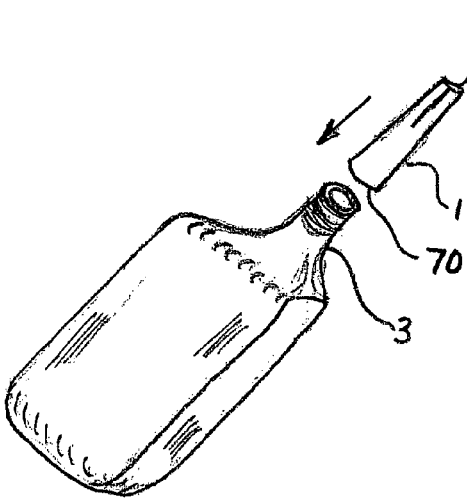
FIG. 4*a* is an isometric view of the spout of FIG. 2*a* being installed on a typical container.
Figure 4B:
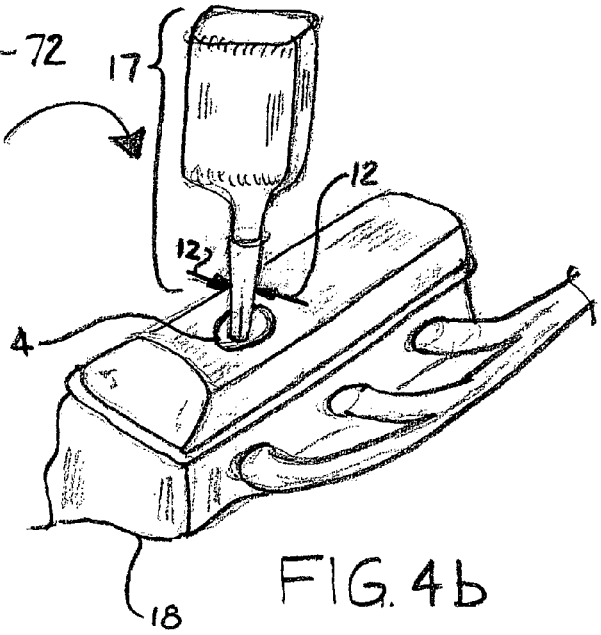
FIGS. 4*b* and 4*c* are isometric views of the spout of FIG. 2*a* and container assembly in use, showing the preferred method of applying force to open seal.
Figure 4C:
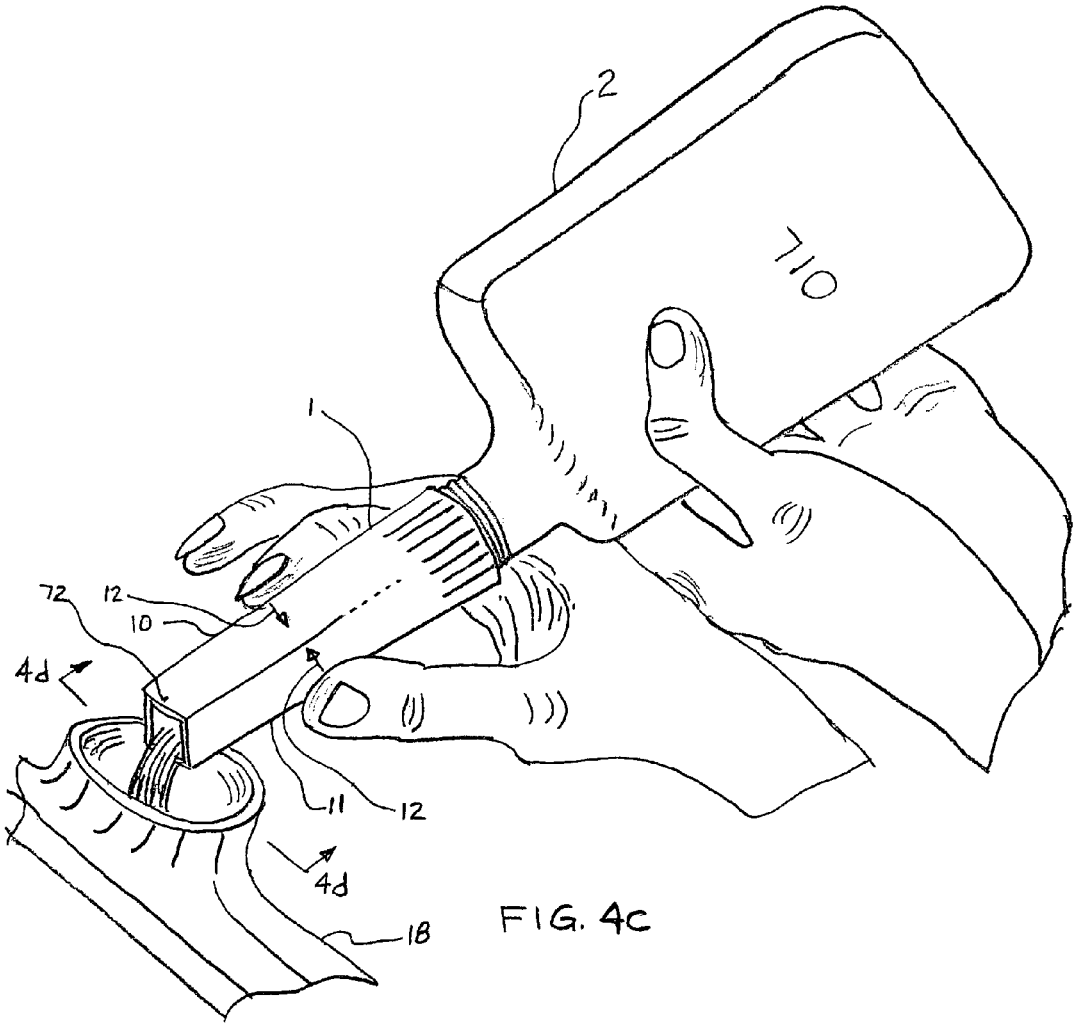
Figure 4D:
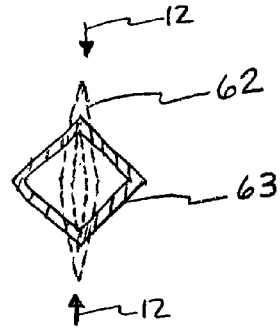
FIG. 4*d* is an end view of the second end of the spout of FIG. 2*a*, as viewed from the section 4*d*-4*d* of FIG. 4*c*, with phantom lines showing the closed position and solid lines with cross-hatch showing the open position, and with fluid not shown.

Referring to FIG. 4*d*, said second opening is configured to be movable between a first, closed position 62, wherein said walls are sufficiently in proximity to one another sealing off the flow of said material through said spout, and a second, open position 63, wherein said side walls are sufficiently spaced apart to form an opening through which said material can flow.

Said second end 72, can be arranged to close off said hollow cross section by pinching together said second end multiplicity of planes 13, 14, 15, 16, and at least two adjacent planes of said multiple planes become essentially coplanar, resulting in at least two substantially opposed planes 8, 9, and said opposed planes 8, 9 are positioned in close proximity and held essentially in a sealed position by a sealing means 7, such that said sealing means 7 is of sufficient location and configuration to hold said opposed planes 8, 9 substantially together, closing off the cross section and preventing the passage or flow of any material. Such an arrangement is considered the closed or sealed position. In the above example the combination of a variable geometry, multi-walled second end 72, and a sealing means 7, constitutes a flow control means or valve means.

Furthermore, said at least two elongated hinge lines 10, 11 extend for at least a partial distance along said spout, while allowing said opposed planes 8, 9 to close, and providing stiffening to the spout, said hinge lines 10, 11, being in an outboard location, also provide a position, at substantially any point along said hinge lines 10, 11, to apply an opposed inward force 12, typically applied by a users thumb and forefinger as shown in FIG. 4*c*. Said opposed inward force 12, which by virtue of the geometry of said hinge lines 10, 11, and said opposed planes 8, 9, transmits an opening force acting to open or spread said opposite planes 8, 9 and overcome said sealing means 7. In this example a distally transmitted opening force is present at the second end as a result of the force being applied to the hinge lines, with the point of application of said force being remote from the second end.

Figure 2A:
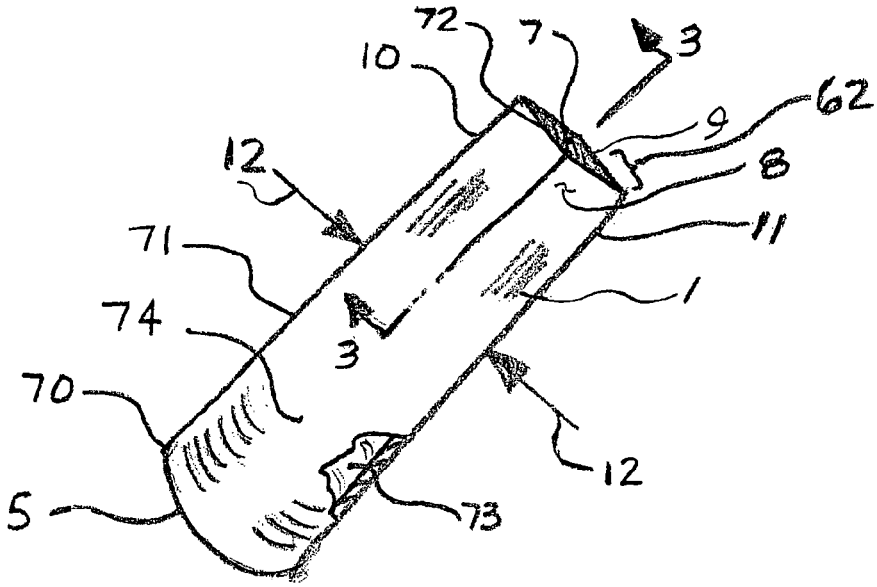
FIG. 2*a* is an isometric view of the. spout in FIG. 1, showing various aspects of the preferred embodiment of the invention.
Figure 2B:
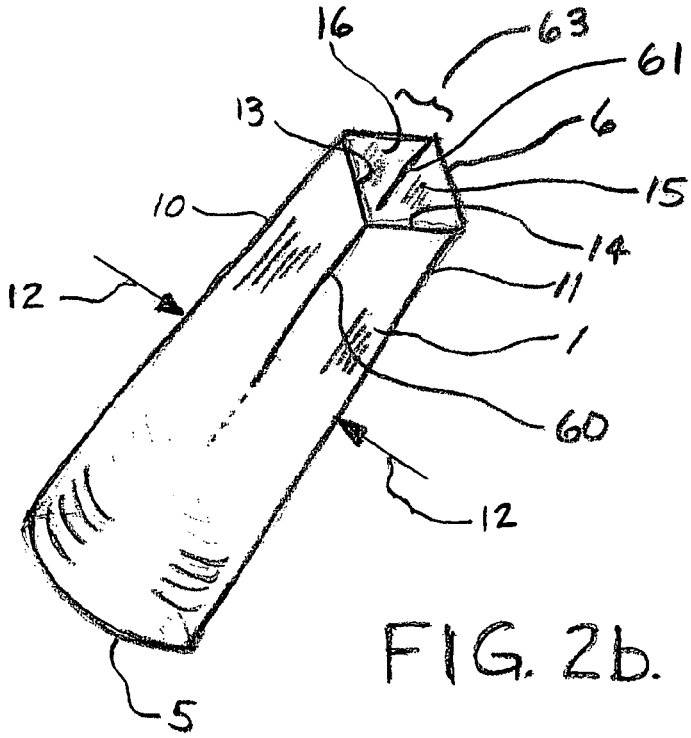
FIG. 2*b* is an isometric view of the, spout in FIG. 2*a*, showing an open second end.
Figure 2C:
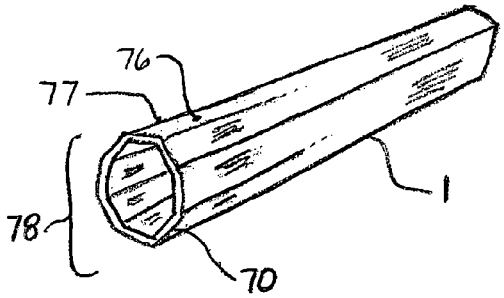
FIG. 2*c* is a bottom isometric view of the, spout in FIG. 2*a*, showing the approximately circular first end.
Figure 3:
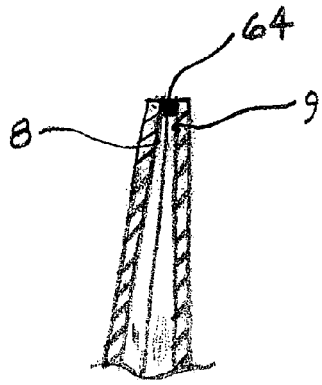
FIG. 3 is a cross sectional view of the second end of the, spout of FIG. 2*a*, in a closed position, as viewed from the section line 3-3 of FIG. 2*a*.

After the application of said opposed inward force 12, and the releasing of said sealing means 7, said opposed planes 8, 9, in said closed position, now return to multiple planes 13, 14, 15, 16, to a substantially multi-walled opening 6, having a sufficient aperture to allow flow of material through said spout extension, and are in said open position. FIG. 2*a* shows said second end 72 in the said closed position, while FIG. 2*b* shows said second end 72 in said open position.

Typically said first end 70 can be noted as the container end, while said second end 72 can be noted as the pouring end.

Said sealing means 7 located in said second end 72, which provides a means to hold said movable walls 13, 14, 15 and 16 in sufficient proximity and seal said second opening 6, may comprise one or a combination of the following means; a) an adhesive material 64 (FIG. 3), holding said second opening 5 in a closed position, and filling any gaps which material may flow, b) an interlocking feature (FIG. 11*a*) on said walls of said second end 72, including but not limited to, embossed ridges (FIG. 11*c*), crimps, or folds (FIG. 11*b*) which stiffen, engage, or connect the walls of said second end, holding said second opening in a closed position, c) a frangible membrane 36 (FIG. 12) covering said second opening 6 and providing closure for said second opening, and, d) magnetic material attached to or incorporated into said second end, providing a magnetic force which holds said second opening in a closed position.

Referring to FIGS. 4*a*, 4*b*, and 4*c*, an example of one mode of operation of the present invention is as follows: Said spout 1, with said second end 72 configured in the sealed or closed position, is assembled to an uncapped container neck 3, with said first end 70 being fitted to said container neck 3. The container and spout assembly 17 is inverted and located into or nearby receiving opening represented in this example as an oil fill opening 4, in an engine 18. Material can flow from said container into said spout, but is stopped by said sealed second end. Once inverted and properly positioned for receiving said material, the user applies said opposing force 12, to any location along said hinge lines 10, 11, which in turn provides a force opening said sealing means 7 in said second end, and allows flow of material out of container through said spout, and into the intended receiver location.

Figure 5:
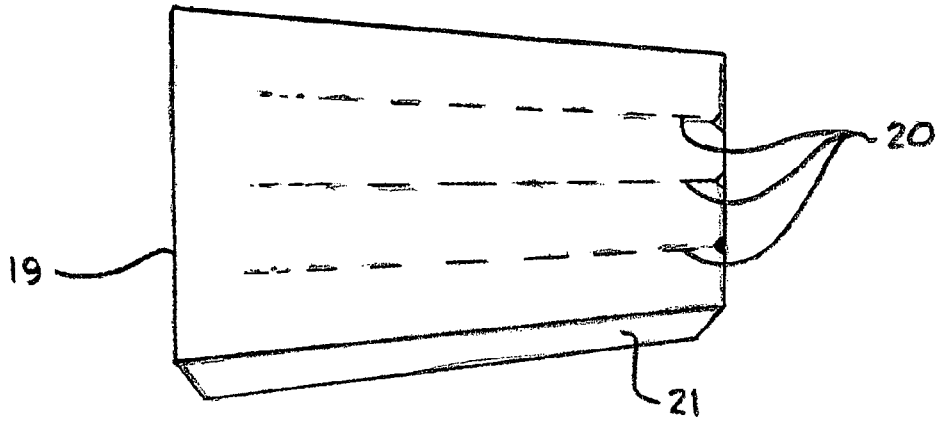
FIG. 5 is an unfolded view of a spout as an embodiment of the invention showing a manufacturing method.

Although many materials and approaches may be employed to manufacture the present invention, including but not limited to injection molding, blow molding, vacuum forming, extrusion, or material lay-up of various thicknesses of materials, FIG. 5 shows an approach where an embodiment of the present invention can be fabricated from paperboard, boxboard, corrugated board, or plastic composite sheet, using techniques to cut and form a blank 19 and partially fold 20 and glue to form said spout. A tab 21 is provided for gluing said structure together when formed into a tubular cross section.

Figure 6:
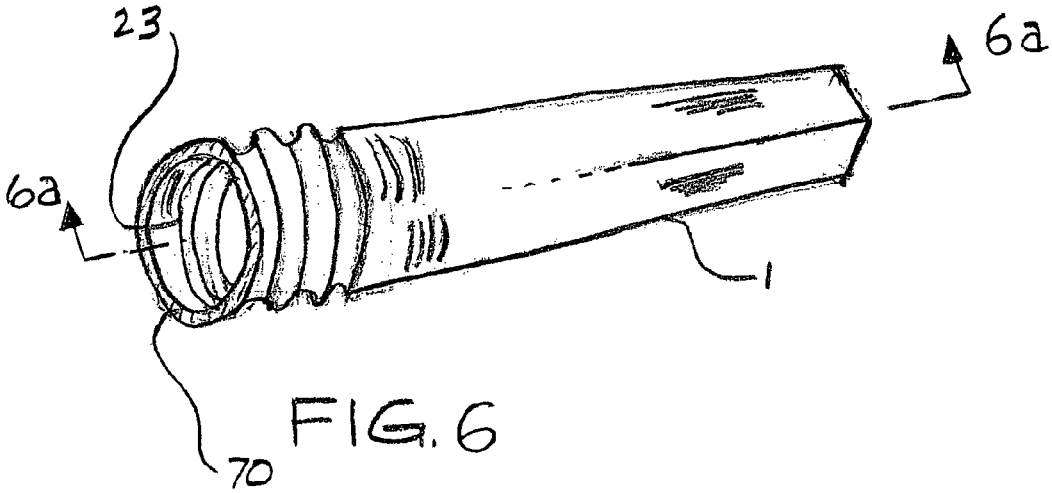
FIG. 6 is an isometric view of an embodiment of the invention with attachment means in the first end.
Figure 6A:
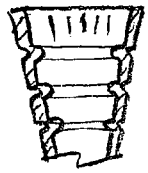
FIG. 6*a* is a cross sectional view of the first end of the spout of FIG. 6, as viewed from the section line 6*a*-6*a* of FIG. 6.

Another embodiment of the invention is shown in FIG. 6 where said circular or first end 70 has threads or at least one or more circular raised ridges 23, which at least partially engage threads or other features, such as the container end, on said container neck 3, providing a means to secure said circular cross section 5 to said container neck 3.

Figure 7:
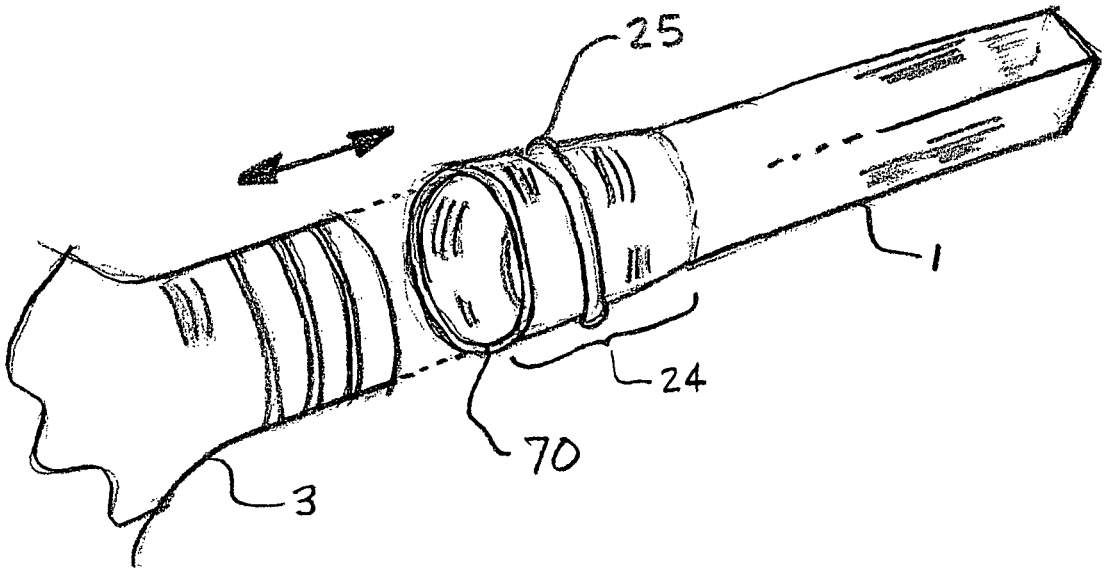
FIG. 7 is an isometric view of the spout as an embodiment being installed on a container neck.

Another embodiment of the invention is shown in FIG. 7, where said container neck 3 is shown moved away for clarity, where said first end 70 has a cone-like varying cross section 24 to adapt to a range of container outlet sizes. Pushing the container neck 3 into the cone-like cross section 24 deforms wall material resulting in a deformation ring 25 on the inside wall, which along with friction acts to couple said neck 3 and said container end 70. A tacky or adhesive like material can also be applied to the inside surface of said first end 70 to assist in attaching and sealing to said container neck 3.

Figure 8:
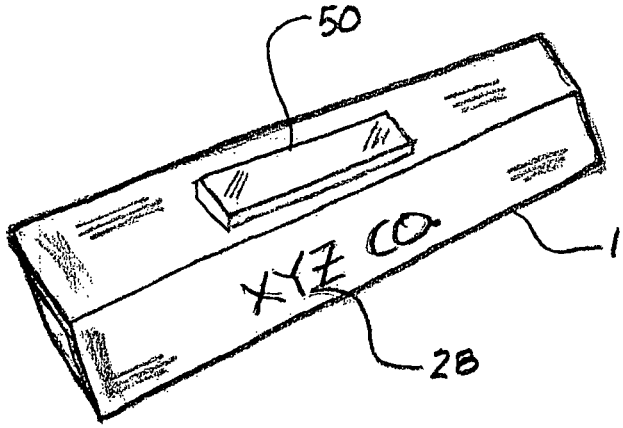
FIG. 8 is an isometric view of an embodiment of the invention folded flat with an absorbent pad and graphical printing.
Figure 9:
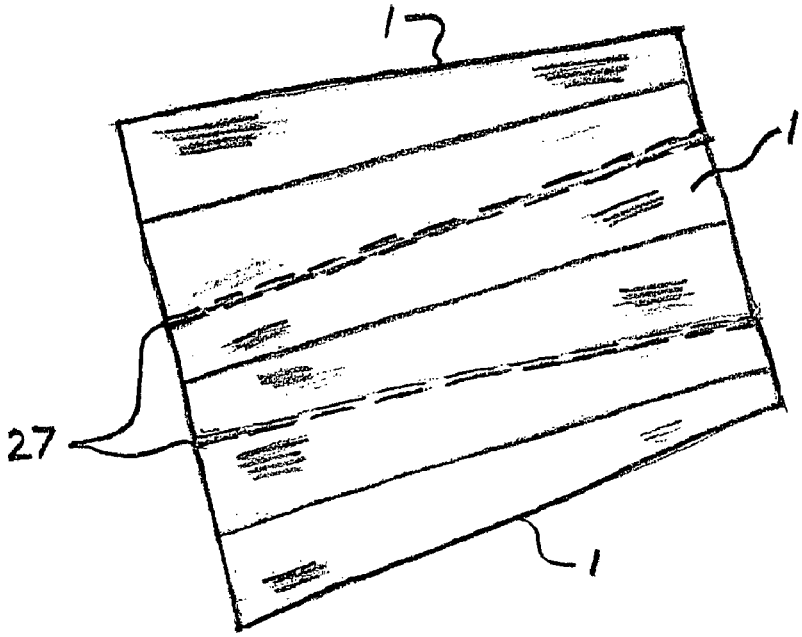
FIG. 9 is an isometric view of an embodiment of the invention in a flat folded position and grouped together with similar units for storage and distribution.

Another embodiment of the invention is shown in FIG. 8 where said elongated spout 1 folds essentially flat such that at least two hinge lines extend the length of the tube allowing both said first and second ends to collapse and fold flat, allowing easier packing and shipping. FIG. 9 shows a multiplicity of said folded spouts joined to form a ganged sheet or roll with separable joints 27, allowing efficient storage and dispensing of said spouts. FIG. 8 shows an embodiment that includes printing of graphics 28 such as logos, advertisements, or instructions. A related embodiment allows said spout to be disposable or a one-time use device. Such a disposable device would solve any contamination issues seen with reusing said spout, and not require any cleaning of said device after use. Another related embodiment includes the attachment of said substantially folded spout or stored spout to said container for storage or procurement of said spout. Said spout can come along with said container when acquired and is ready for use by un-attaching said spout from said container. Said folded spout can be incorporated into the label of said container.

Another embodiment of the invention is disclosed where said hollow elongated spout is substantially circular in crossection along essentially the entire length, said second end being sealed by substantially pinching off said circular crossection, where said inside surfaces near said second opening are brought into proximity and said circular crossection transitions to a line, and having a sealing means holding said inside surfaces in proximity.

Another embodiment of the invention is disclosed where said elongated spout 1 is part of said container 2 as a combination, said combination resulting as a container with an integral spout of the disclosed design.

Figure 10:
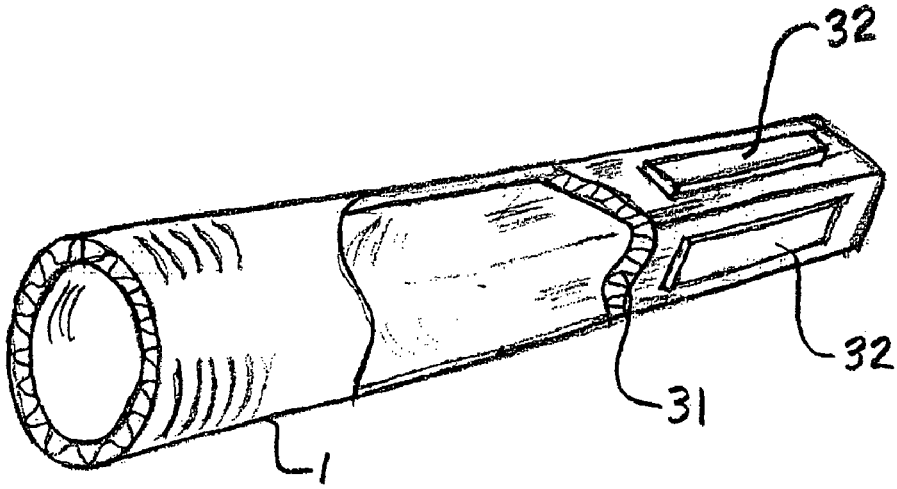
FIG. 10 is an isometric view of an embodiment of the invention with stiffened and doubled walls.

Another embodiment of the invention is shown in FIG. 10 where the addition of corrugation 31 of the material, as shown in the cutaway view, may be used to alter the stiffness of said spout as required. Additionally, doublers 32, may be added to stiffen selected regions of said spout structure.

Figure 11:
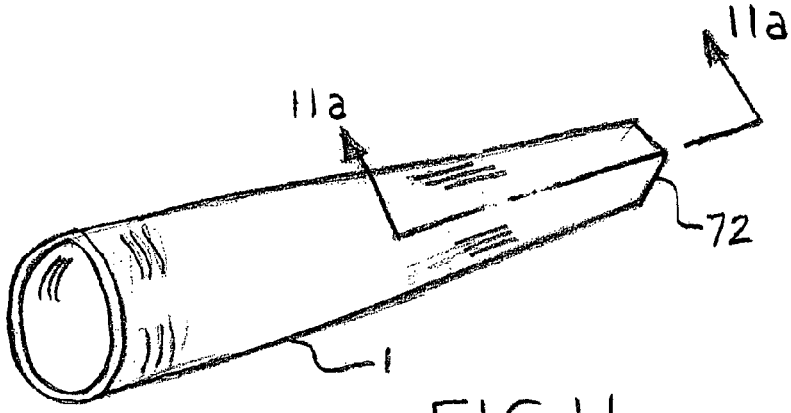
FIGS. 11, 11*a*, 11*b*, and 11*c* are isometric views of an embodiment of the invention with interlocking features as a sealing means.
Figure 11A:
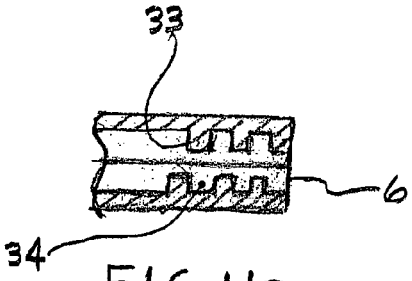
Figure 11B:
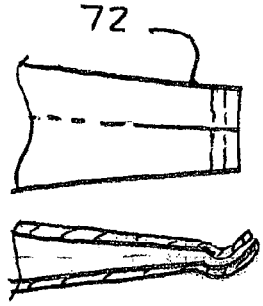
Figure 11C:
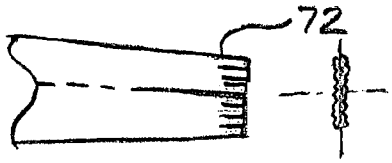
Figure 12:
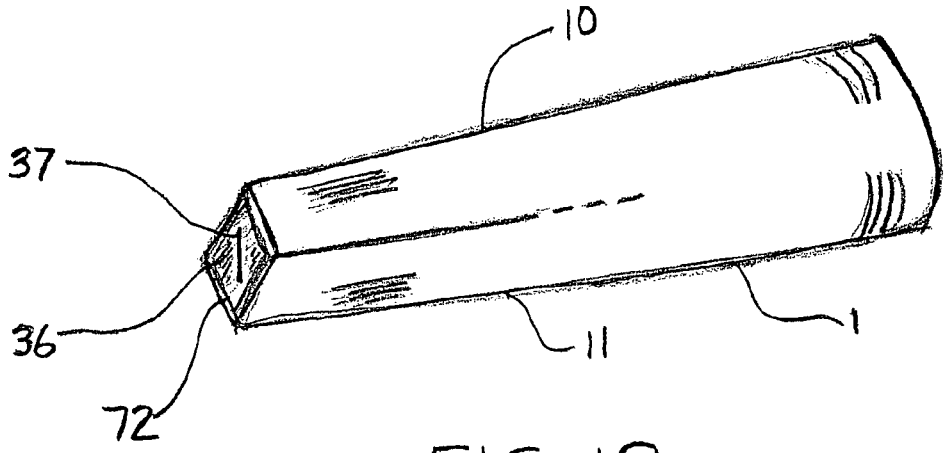
FIG. 12 is an isometric view of an embodiment of the invention with a frangible membrane.

Another embodiment of the invention is shown in FIGS. 11, and 11*a*, where said sealing means at said second end 72 consists of a multiplicity of interlocking features, shown as labyrinth type appendages 33, and a multiplicity of substantially matching voids 34, attached to said opposed surfaces which, when brought together, engage and form a seal, as shown in FIG. 11*a*, in the unengaged or open position. The closed position of this sealing technique would occur when both sides of the labyrinth seal are brought together so that said appendage 33 are inserted into void 34 and are held together by friction, compression, or variations in geometry which resist separation of said appendage 33 and said void 34.

Other interlocking features may be applied to said second end to provide said sealing means, including but not limited to, crimping said surfaces (FIG. 11*c*) to form said closed position, applying at least a partial fold (FIG. 11*b*) across said second end which holds said surfaces in said closed position, and embossing a pattern through said second end which provides said sealing means to hold said second end in said closed position.

Another embodiment of the present invention is disclosed where said sealing means consists of a weakened area of the base material of said second end 72, and said walls designed to break or tear when said opening force is applied. Said weakened area may be comprised of a thinned material section or a perforated line.

Another embodiment of the invention can be described by referring to FIGS. 2*a* and 2*b*, where said sealing means consists of ferro-magnetic or magnetic particles attached to, or included in the material of said opposed surfaces 13, 14, 15, and 16, providing magnetic attraction to provide a force which holds said second end 72 in said closed position. Said magnetic sealing means also provides a means to re-seal or close said second end 72 after said second end was moved to said open position.

Another embodiment of the invention is disclosed where said sealing means 7 has the capability to open and close, whereby the means to re-seal and thus shut off flow of material is realized.

Another embodiment of the invention can be described by referring to FIGS. 2*a* and 2*b*, where said sealing means 7 consists of a pliable adhesive material 64, which is in contact with at least part of said walls in said second end 72, and holds said planes 8 and 9 in proximity. Said adhesive material 64 releases contact with at least one plane or alternately fractures, due to said opening force, allowing said second end 72 to move to said open position.

Another embodiment of the invention can be described where at least some portion of said spout extension 1 material is optically transparent to visually see material in flow.

Another embodiment of the invention is shown in FIGS. 4-812 and viewed from said second end 72, where said sealing means 7 consists of a frangible membrane 36 spanning said second opening 6, providing closing for said second end 72. Said membrane 36 has at least one predetermined weakened areas 37. Any changes in geometry of said second end 72, due to applied forces to said hinge folds 10, 11 will cause a rupture or partial detachment of said membrane 36 from said second end, and allow material to flow. Said membrane 36 with at least one weakened areas 37 can also be ruptured or partially detached by an increase in pressure due to squeezing on said container 3.

Figure 13:
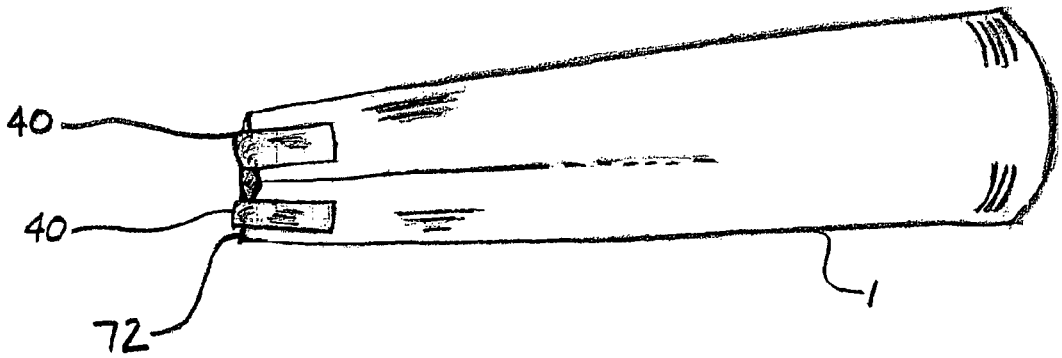
FIG. 13 is an isometric view of an embodiment of the invention with tape bands.

Another embodiment of the invention is shown in FIG. 13 where at least one safety or tape band 40 are shown installed over a closed second end 72. Said tabs 40 provide a closing force closing said second end 72.

Figure 14:
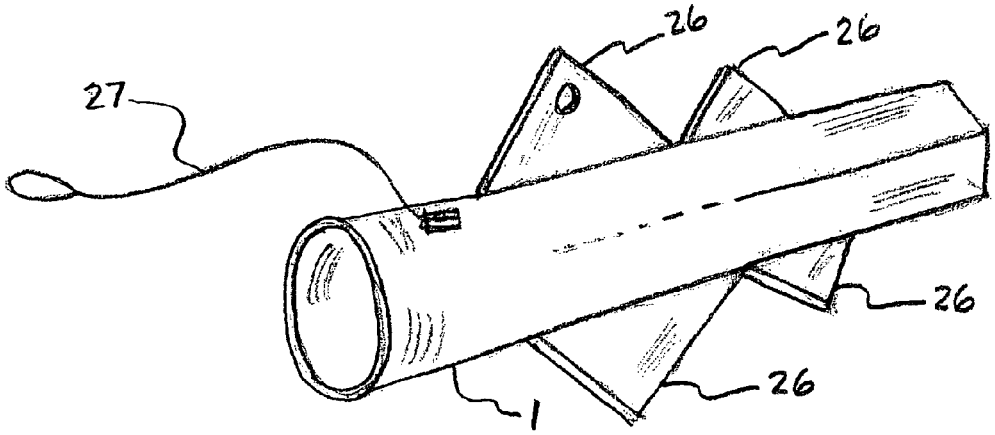
FIG. 14 is an isometric view of an embodiment of the invention with outward appendages.

Another embodiment of the invention is shown in FIG. 14 where said elongated spout 1 has a multiplicity of outwardly extending appendages 26, of appropriate sizes and shapes, to provide means to support said elongated spout 1 when inverted and inserted in an opening of the receiving container or equipment. Said appendages prevent said spout from being fully inserted or falling into said receiver opening. Also shown is a tether 27 which may be included and used to secure said elongated spout 1 to said container 2.

Another embodiment of the invention is shown in FIG. 8 where an absorbent patch 50 is included and temporarily attached to the elongated tube 1. Said absorbent patch consists of absorbent material and may be removed, unfolded, and used as a wipe to clean up any drips.

Figure 15:
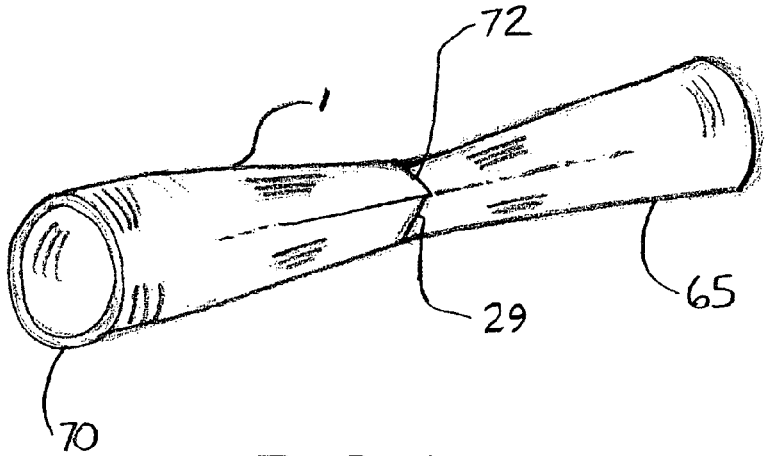
FIG. 15 is an isometric view of an embodiment of the invention with an extension past the second end.

Another embodiment of the invention is shown in FIG. 15 where said sealing means or valve means 29 is located approximately midway along, the length of the elongated spout 1. An elongated extension 65 continues after said second end allowing said sealing means to be located away from the opening where said material will exit the device.

Figure 16:
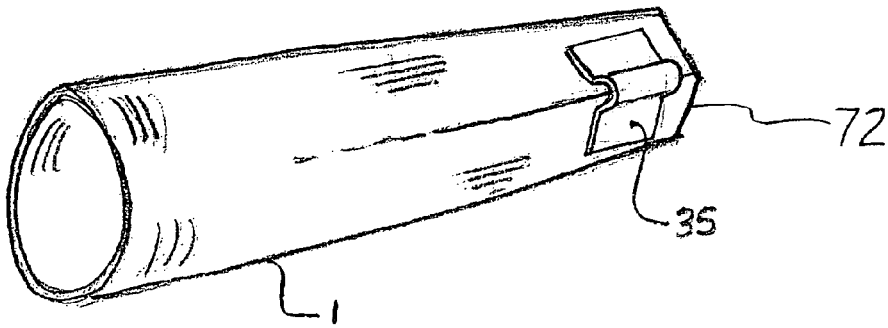
FIG. 16 is an isometric view of an embodiment of the invention with spring members.

Another embodiment of the invention is shown in FIG. 16 where at least one flat spring 35 is included to provide an over-center spring function or bi-stable closure for said sealing means for said second end 72. Bi-stable holding forces would maintain said second end in said first closed position and in said second open position. At least one spring 35 may also be configured to provide a mono-stable closure, which would require a continuous force to hold in the open state. Said spring provide a torsional force to said wall and hinge line. Said spring function can be made part of said second end by molding or forming into said spout material, eliminating the need for said external spring 35.

Figure 17:
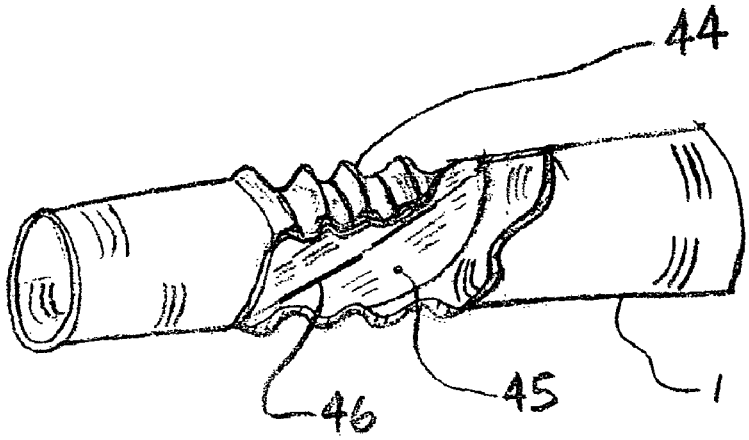
FIG. 17 is an isometric view of an embodiment of the invention with an internal membrane connected to internal surfaces.

Another embodiment of the invention is shown in FIG. 17 where a flexible section 44 is included essentially midway along said elongated spout 1. A membrane 45 is included and shown in the cutaway view, and said membrane 45 is connected to at least some internal surfaces on either side of said flexible section 44, and when intact serves to block the flow through said elongated spout 1. Said membrane 45, may have at least one weakened area 46. The motion of flexing or elongating said flexible section applies stress to said membrane 45 and either ruptures said weakened area 46 or serves to at least partially detach said membrane 45 from the internal surfaces of the elongated spout 1, allowing flow of said material.

Figure 18:
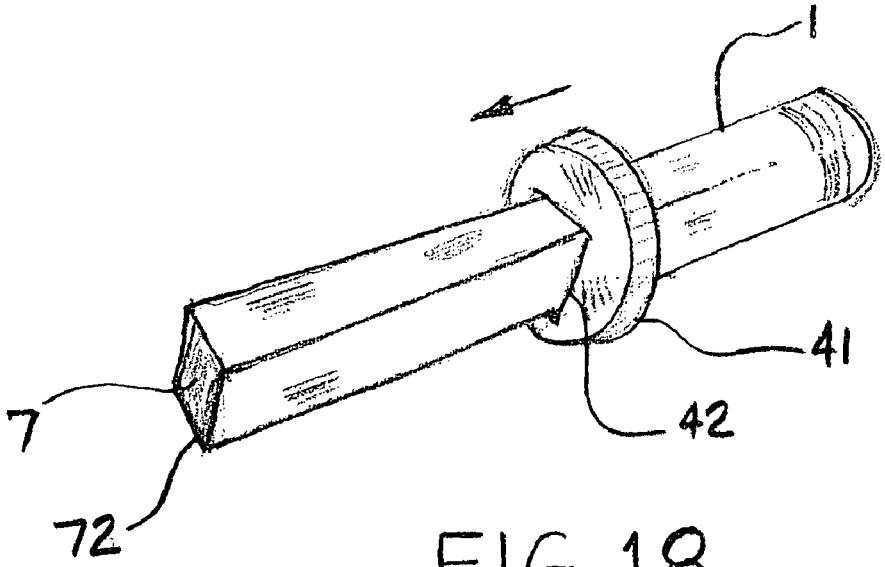
FIG. 18 is an isometric view of an embodiment of the invention with a sliding member.

Another embodiment of the invention is shown in FIG. 18 where an axial sliding member 41, having a predetermined inside profile 42, is free to slide along at least part of the length of said elongated spout 1. Said second end 72, may be set in said closed position with a geometry that does not match that of said sliding members inside profile 42. As said sliding member 41 is moved along said spout, the cross sectional geometry of said spout 1 is forced to match said predetermined shape of said inside profile 42, which in turn changes the geometry of said second end 72, and provides a force to open said sealing means 7. Stopping means are included to prevent said slider 41 from being separated from the elongated spout 1. A related embodiment is disclosed which uses said sliding member 41 as shown, however the embodiment is configured such that a rotational or twisting motion of said sliding member 41 causes a geometric change in said second end 72, resulting in an opening of said sealing means 7.

Although only several preferred embodiments of the invention have been specifically illustrated and described herein, it will be appreciated by those skilled in the art that various modifications, alterations, or combinations may be made without departing from the scope and spirit of the present invention.

I claim:

1. A spout for the transfer of material from a container, comprising:

a continual, straight, elongated hollow member that surrounds a single axis with two approximately aligned openings on opposite distal first and second ends of the hollow member, said elongated hollow member having an inside surface and an outside surface, said first end having a first opening, and said second end having a second opening, said outside surface being a transitional blend formed by transitioning smoothly from at least, the cross-sectional shape of said first opening, to the cross-sectional shape of said second opening, said first end being attachable to the outlet of said container by force fitting said first end over said container outlet, whereby said spout is structurally attached to said container, said second end having a plurality of substantially flat walls, said walls interconnected by substantially axial hinge lines, said second opening being movable from a first, closed position to a second, open position, said flat walls of said second opening, being substantially flat in said open position and in said closed position, said second end having sealable means for sealing said second opening in a closed position, preventing flow of material.

2. The device according to claim 1, wherein said elongated hollow member is collapsible to a flat folded position, and where a pair of straight hinge lines in said first opening substantially meet a pair of straight hinge lines in said second opening, allowing said hollow member to fold flat.

3. The device according to claim 1, wherein said inside surface of said first end is at least partially radially compliant to deform to the shape of the outlet of said container, when said container outlet is fitted to said first end.

4. The device according to claim 1, wherein said second opening has a substantially rectangular shape, and said first opening has a substantially circular shape, said first opening circular shape being approximated by at least four essentially flat wall sections interconnected by hinge lines.

5. The device according to claim 1, where said second end further includes at least one spring element being attached to said movable walls, whereby said spring element provides at least one directional holding force in a first, closed position of said second opening.

6. The device according to claim 1, where said sealing means in said second opening comprises an element from the group consisting of;

an adhesive material, at approximately the second end of said hollow member, adapted for holding the substantially flat walls in a closed position, an interlocking feature at approximately the second end of said hollow member, consisting of at least one raised feature on the inside surface of one wall that fits into at least one depressed feature on the inside surface of the opposed wall, adapted for holding the substantially flat walls in a closed position, a frangible membrane covering said second opening, and, at least part said second end being made of a magnetic material, adapted for holding the substantially flat walls in a closed position.

7. The device of claim 1 wherein said elongated member is adapted to be assembled into a single piece.

8. The device according to claim 1 wherein said plurality of substantially flat walls are positioned into two substantially opposite planes, with said elongated hollow member adapted to open said second end with an opposed approximately inward force applied to any location along said hinge lines, and said walls being sufficiently rigid to allow said second end to open.

9. The device according to claim 1 wherein said hollow member has at least one raised ridge that approximates the diameter of a container outlet, aligned on said axis, positioned no more than four inches from said first opening, and is configured to assist in attachment of the container.

10. The device according to claim 1 wherein said walls of said first end have a deformable approximate cone shape, whereby pushing said cone shaped first end of said hollow member, onto the outlet of said container forms a deformation ring, approximately equal to the diameter of the container outlet, assisting in coupling said hollow member to said container and providing coupling to various sizes of said container outlets.

11. The device according to claim 1, wherein said elongated member further includes at least one outwardly extending appendage.

12. The device according to claim 1, wherein said elongated member further includes at least one piece of absorbent material temporarily attached to said outside surface, whereby said piece of absorbent material can be removed and used to absorb spillage or wipe up unwanted material.

13. The device according to claim 1, wherein said elongated member further includes an elongated extension, continuing after said second end, whereby said sealing means is then located approximately inward from open end of said extension.

14. The device according to claim 1, wherein said elongated member further includes at least one moveable element, at least partially surrounding said elongated member, said movable element being slideable along or rotatable about the axis of said elongated member, whereby said movable element, having an internal shape, such that motion of said movable element causes a geometric change in said second end, resulting in said open position of said second end.

15. The device according to claim 1, wherein said second end further includes at least one tape band, affixed to said outside surface of said second end of said elongated member, holding said second end in said closed position.

16. The device according to claim 1, wherein said elongated hollow member has at least part being made of a transparent material.

17. The device according to claim 1, wherein said elongated member consists of a sheet of material that is cut, folded and joined.

18. A spout for the controlled transfer of material from a container in an inverted position, comprising:

a continual, single piece, straight, elongated hollow member that surrounds a single axis with two aligned openings on opposite distal ends of the hollow member, said elongated hollow member having a first end, and intermediate portion, and a second end, said elongated hollow member having an inside surface and an outside surface, said first end having a first opening and said second end having a second opening, said outside surface being a transitional blend formed by transitioning smoothly from at least, the cross-sectional shape of said first opening, to the cross-sectional shape of said second opening, whereby there are no sharp transitions of said outside surface as it transitions from said first end to said second end, said first opening being substantially circular and said first end being tapered in the longitudinal direction to provide a force fit with predetermined sizes of outlets of said container, whereby said spout can be structurally attached to the outlet of said container as an extension, said second opening having a plurality of flat walls, said walls joined by hinge lines, said walls and hinge lines extending at least partially along the length of said elongated member, said second opening being movable between a first, closed position and a second open position, wherein said first closed position said walls are sufficiently in proximity to one another sealing off the flow of said material through said spout, and wherein said second open position said walls are sufficiently spaced apart to form an opening through which said material can flow, said flat walls of said second opening, joined by hinge lines, being flat in said open position and in said closed position, said second opening having an adjacent adhesive seal for sealing said second opening, whereby said seal provides a means to hold said movable walls in sufficient proximity and close said second opening.

* * * * *